US007031840B1

(12) United States Patent
Brett et al.

(10) Patent No.: US 7,031,840 B1
(45) Date of Patent: Apr. 18, 2006

(54) DRILLING PERFORMANCE ASSESSMENT PROCESS

(75) Inventors: James Ford Brett, Tulsa, OK (US); Edward John Behm, Jr., The Woodlands, TX (US)

(73) Assignee: Oil & Gas Consultants International, In., Tulsa, OK (US)

( * ) Notice: Subject to any disclaimer, the term of this patent is extended or adjusted under 35 U.S.C. 154(b) by 106 days.

(21) Appl. No.: 10/751,819

(22) Filed: Jan. 5, 2004

(51) Int. Cl.
*G01V 9/00* (2006.01)

(52) U.S. Cl. ..... 702/9

(58) Field of Classification Search ..... 702/6, 702/9; 703/10; 705/7, 11
See application file for complete search history.

(56) References Cited

U.S. PATENT DOCUMENTS 5,216,917 A * 6/1993 Detournay ..... 73/152.59
6,836,731 B1 * 12/2004 Whalley et al. ..... 702/13

* cited by examiner

*Primary Examiner*—Donald McElheny, Jr.
(74) *Attorney, Agent, or Firm*—Head, Johnson & Kachigian

(57) ABSTRACT

A method to create a drilling performance assessment ratio. The ratio includes the steps of establishing a technical minimum time limit standard for each of multiple sequential steps required for a drilling operation. Actual time performance for each of the multiple steps is measured for an actual drilling operation. The actual performances are compared to the technical time limit standards in order to produce a drilling performance ratio.

12 Claims, 9 Drawing Sheets

Perfect Well Assumptions – Operational Times…

| Process Step | Perfect Time | Justification |
|---|---|---|
| **BOP Rig up / Test** | 3 hrs | Consensus "perfect" time |
| **Drillout / LOT** | 1 hrs | Consensus "perfect" time |
| **Trip time - Cased Hole** | 5400 ft/hr | 90 ft stands; 35 sec lift, 15 sec break, 10 sec down |
| **Trip Time - Open Hole** | 3400 ft/hr | 90 ft stands; 70 sec lift, 15 sec break, 10 sec down |
| **Drilling Connection** | 982 ft/hr | 30 ft joints; 20 sec up, 15 sec break, 15 sec make, 15 sec up, 15 sec make, 30sec to bottom and Drill |
| **Cut Rock** | Depends on Sonic Log, & Mud Weight | Use "Specific Energy" w/ perfectly sharp bit to estimate time required to penetrate formation (assume 100 HP on bottom, for holes above 8.5", and 60 HP Hole smaller holes ) |
| **Casing Running Time** | 2700 ft/hr | 45 ft joint; 10 sec lift, 15 sec make, 35 sec down |
| **Mix and Pump C ment** | 5 bbl/min mix 20 bbl/min pump | Consensus "perfect" time Cementing time assumes we place 1000ft behind Casing – uses casing/hole size. |
| **Logging** | 2000 ft/hr | 15 min. rig up and down time, and 2000 ft/hr over interval of interest - one pass |

Perfect Well Assumptions – Operational Times…

| Process Step | Perfect Time | Justification |
|---|---|---|
| **BOP Rig up / Test** | 3 hrs | Consensus "perfect" time |
| **Drillout / LOT** | 1 hrs | Consensus "perfect" time |
| **Trip time - Cased Hole** | 5400 ft/hr | 90 ft stands; 35 sec lift, 15 sec break, 10 sec down |
| **Trip Time - Open Hole** | 3400 ft/hr | 90 ft stands; 70 sec lift, 15 sec break, 10 sec down |
| **Drilling Connection** | 982 ft/hr | 30 ft joints; 20 sec up, 15 sec break, 15 sec make, 15 sec up, 15 sec make, 30sec to bottom and Drill |
| **Cut Rock** | Depends on Sonic Log, & Mud Weight | Use "Specific Energy" w/ perfectly sharp bit to estimate time required to penetrate formation (assume 100 HP on bottom, for holes above 8.5", and 60 HP Hole smaller holes ) |
| **Casing Running Time** | 2700 ft/hr | 45 ft joint; 10 sec lift, 15 sec make, 35 sec down |
| **Mix and Pump C ment** | 5 bbl/min mix 20 bbl/min pump | Consensus "perfect" time<br>Cementing time assumes we place 1000ft behind Casing – uses casing/hole size. |
| **Logging** | 2000 ft/hr | 15 min. rig up and down time, and 2000 ft/hr over interval of interest - one pass |

Fig.1

Operations Improvement Table

| Item | Well or Group | Observation |
|---|---|---|
| 1 | 9 | Best well beat technical limit, tech limit suspect |
| 2 | 14 | Average beat best competitor well though at a 6 ratio |
| 3 | 9, 10, 12, 15, 19, 23, 24 | Good risk management (low average to best spread) |
| 4 | 13, 15 | Tech Limit ratio to perfect near 2.0-2.5, consistent |
| 5 | 17-24 | Best performance is better than a perfect ratio of 3.0 |
| 6 | 6, 7, 11, 14, 15, 16, 18, 20, 21 | Large average to best spread, target improvements |
| 7 | 4, 5 and 6, 7 | Deeper exploration wells performed similar to developmen |
| 8 | 2 | Performance 50% worse than should be expected |
| 9 | 10 and 13 | Appraisal drilling as efficient as later development |

Fig.4

- The .97 correlation coefficient is excellent.
- The variation in drilled depths yields a sufficient range of times to yield a decent spread for correlation.
- Deep Water scale is significant with high day rates yielding significant benefits from performance improvements.

| PW Ratio | Well Cost w/full Savings | Well Cost w/ 1/2 Savings |
|---|---|---|
| 8 | 879 | 879 |
| 6 | 754 | 816 |
| 4 | 611 | 745 |
| 2 | 468 | 673 |

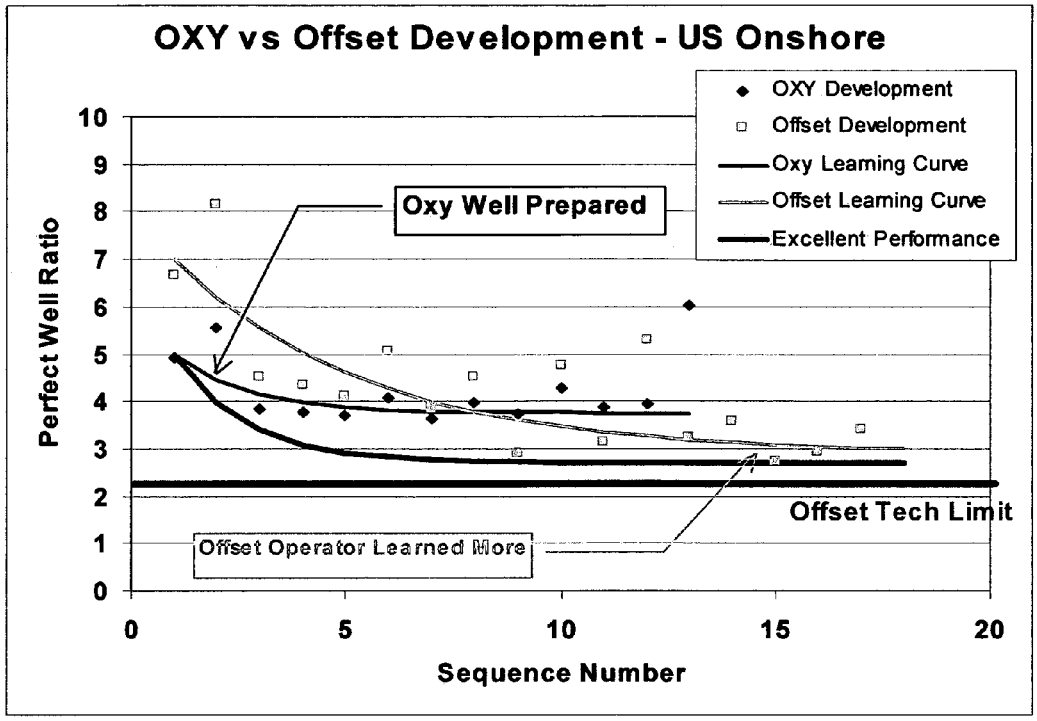

Figure 8 compares two developments in a similar setting. Both programs basically had the same average PWR of 4.3 and cost average of ~.5 million dollars.

Oxy was clearly better prepared while the competitor worked to eventually become more efficient. Both entities clearly have room to improve though not obvious from average data that shows the programs to be the same.

Fig.8

DRILLING PERFORMANCE ASSESSMENT PROCESS

BACKGROUND OF THE INVENTION

1. Field of the Invention

The present invention relates to a process to create an objective drilling performance assessment system. In particular, the present invention provides a method to create a drilling performance assessment ratio that may be used to evaluation drilling performance and identify promising opportunities to improve drilling operations.

2. Prior Art

Oil, gas, and other drilling operations comprise a number of discreet operations, which are performed in a sequential order in order to perform the overall drilling operation. The actual steps, while subject to variation, are well known. As the process of drilling requires huge investments of capital equipment and investments of personnel, there are continuing efforts to improve the efficiency and improve the performance of the drilling operations. In the past, different types of performance analysis techniques have been applied including technical limit analysis, learning curve analysis, and benchmark studies.

In technical limit analysis, an estimated well duration is generated by a group process whereby experts consider the best time observed on an operation and estimate the best possible time given the situation based on experience with a particular type of well, and with a particular set of equipment.

The prior techniques are based either on human judgment or past performance, not on objective standards. Each of the prior analysis techniques is difficult to produce and sometimes statistically inconsistent.

One difficult part in evaluating drilling performance is comparing the performance of wells in different situations, such as different business entities, different depths, lithology, or complexity. Additional factors include pressure regime, hole size program, vertical, directional, horizontal or multilateral drilling, and rank wildcat vs. routine development.

It would be advantageous to develop a process that could compare drilling performances in different business entities and under different conditions in order to identify where to most effectively apply drilling engineering or operational resources.

It would also be advantageous to provide a process to improve petroleum drilling operations by helping identify promising opportunities to improve performance and efficiencies.

It would also be advantageous to provide a process to set performance targets and identify where savings could be found.

SUMMARY OF THE INVENTION

The present invention begins with utilization of certain technical minimum time limit standards for various sequential steps, sometimes described as "perfect well analysis". The purpose of perfect well analysis is to identify an unambiguous quantitative minimum time benchmark for drilling a particular well.

The "Perfect Well Time" described here is a calculated minimum time that a well could possibly be drilled, and is based on clearly defined objective physical factors that constrain the drilling time (rock specific energy, operational limits, number of casing strings, hole size, etc). It is the Physical Limit that represents how fast the well could possibly be drilled limited by the physics of the drilling process.

Given a geologic sequence, a hole-size program, mud weight, and a particular rig, physics limit how fast drilling operations can possibly be conducted. If you have 100 horsepower of mechanical energy to apply to the bottom of a well, then you will be able to break a certain strength rock only so fast—even with a perfectly sharp bit, and perfect hole cleaning. Perfect well analysis uses such physical limits to find a close approximation to the minimum time a well could possibly be drilled. It assumes one bit per hole section, with penetration rate limited by the horse power available from the rig and the rock strength, perfect trip times, casing and cementing operations, etc, to closely estimate the minimum time physics would let a particular well be drilled.

The only inputs needed for this analysis are the hole-size program, an estimate of the rock strength (accurately derived from a sonic log or seismic travel times in the area), pore pressure, and a few parameters about the drilling rig to be used.

The "Perfect Well" time estimated is a bit like knowing the "irreducible oil saturation" of a subterranean reservoir. Just as comparing the irreducible saturation with the oil in place identifies opportunities for production, comparing the Perfect Well time with actual performance identifies opportunities for improved drilling performance. The perfect well is a drilling limit, therefore not economic or even achievable—just as producing a reservoir to the irreducible saturation is neither economic nor achievable. It is useful to know it because when compared to actual drilling performance, the perfect well ratio identifies the potential for drilling improvement like a low recovery factor yields possible opportunities for reserves improvement. Operations relatively close to their perfect well will be difficult to improve, and those farther away should be easier to improve.

The perfect well ratio (actual time/perfect time) then becomes a parameter yielding an apparent gap in performance which then may be used to compare similar operations, programs, and the portfolio of a company's drilling operations as well as peer performance.

The Perfect Well described here is the minimum time that a well could possible be drilled, and is based on clearly defined physical factors that constrain the drilling time (for example, rock specific energy, operational limits, number of casing strings, hole size, etc.).

The concept of estimating the "technical limit" is well known in the literature. What is described here is a technique that allows one to consistently calculate the physical or mechanical limit for a particular drilling operation (and thus create well cost estimates and identify opportunities for improvement) using a quick and simple technique that converts standard operational times and a specific energy approach (using correlations between sonic travel time and rock strength) to calculate the minimum time to drill an interval to a "perfect well time" (PWT). The PWT is a close approximation of the minimum time possible to drill a particular well.

That time can then be used to compare the performance of different operations by comparing the ratio of the actual performance to the PWT to define a "Perfect Well Ratio" (PWR). Standards for PWR for different types/complexity of operations can then be defined to classify wells by different degrees of difficulty.

Comparing the "perfect well" time with actual performance is used to identify situations where application of drilling technology, engineering or operational expertise may yield performance improvements. The perfect well ratio is an indicator of overall performance and yields measurement useful for companies identifying and sharing best practices. Furthermore, by knowing the perfect time we can also identify visible and invisible lost time, and create an improvement plan.

Perfect well ratios examined over time provide learning rates, amounts, and may be used to estimate future funding levels required to complete multi-year development capital requirements (perfect cost estimating).

In one non-limiting example of an application of the present invention, new venture/project capital estimates may be made with worldwide knowledge of like drilling performance.

BRIEF DESCRIPTION OF THE DRAWINGS

FIG. 1 is a chart illustrating a series of process steps used to define a perfect well time as one factor as set forth in the present invention;

FIG. 4 is a table describing observations regarding possible operations improvement derived from the data in FIG. 3;

FIG. 8 is a chart illustrating the perfect well analysis of the present invention with learning curve analysis.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

In one example of the present invention shown in FIG. 1, to define a perfect well each hole interval has the following process steps. It should be noted that some steps may be deleted if, for example, there is no logging or casing. The time required to accomplish each interval is then the sum of each 'perfect well time' to accomplish each process step.

For instance, as shown in the initial process step, a blow out preventer which is utilized at a well site will be connected to various utility lines at the drilling rig and then moved into place over the wellbore. The blow out preventer is also tested to make sure it is operational. A "perfect time" will be established in which the foregoing operations could theoretically be performed, in this case for 3 hours.

Thereafter, a second process step of performing a drill out and leak-off test is examined. A perfect time of one hour is established as the theoretical minimum time period to perform the process.

In order to establish the perfect well parameters, a number of assumptions are made. These assumptions include:

- Only one drill bit per hole section
- The well will always be pressurized at balance
- No waiting on cement at the drilling rig site (beyond Rig-up/BOP, Trip in, Drillout)
- Perfect Hole Cleaning
- Always place 1000 ft of cement behind pipe
- Mix Cement at 5 barrels a minute and pump at 20 barrels a minute
- Take 30 min. to rig up to pump cement
- Rate of Penetration limited by rig on bottom horse power
- No trouble time of any form: Stuck pipe, geologic sidetracks, waiting on weather,
- No "Hidden" lost time of any form: circulating to condition mud, waiting on cement, short trips It is assumed that there will be no additional data gathering other than a one pass logging run described above in perfect well calculation. Wells requiring more data are 'information wells' and should be analyzed separately from standard development drilling to gauge their drilling performance. They will have higher ratios associated with activities not relating to drilling the most efficient well.

Figure 2:
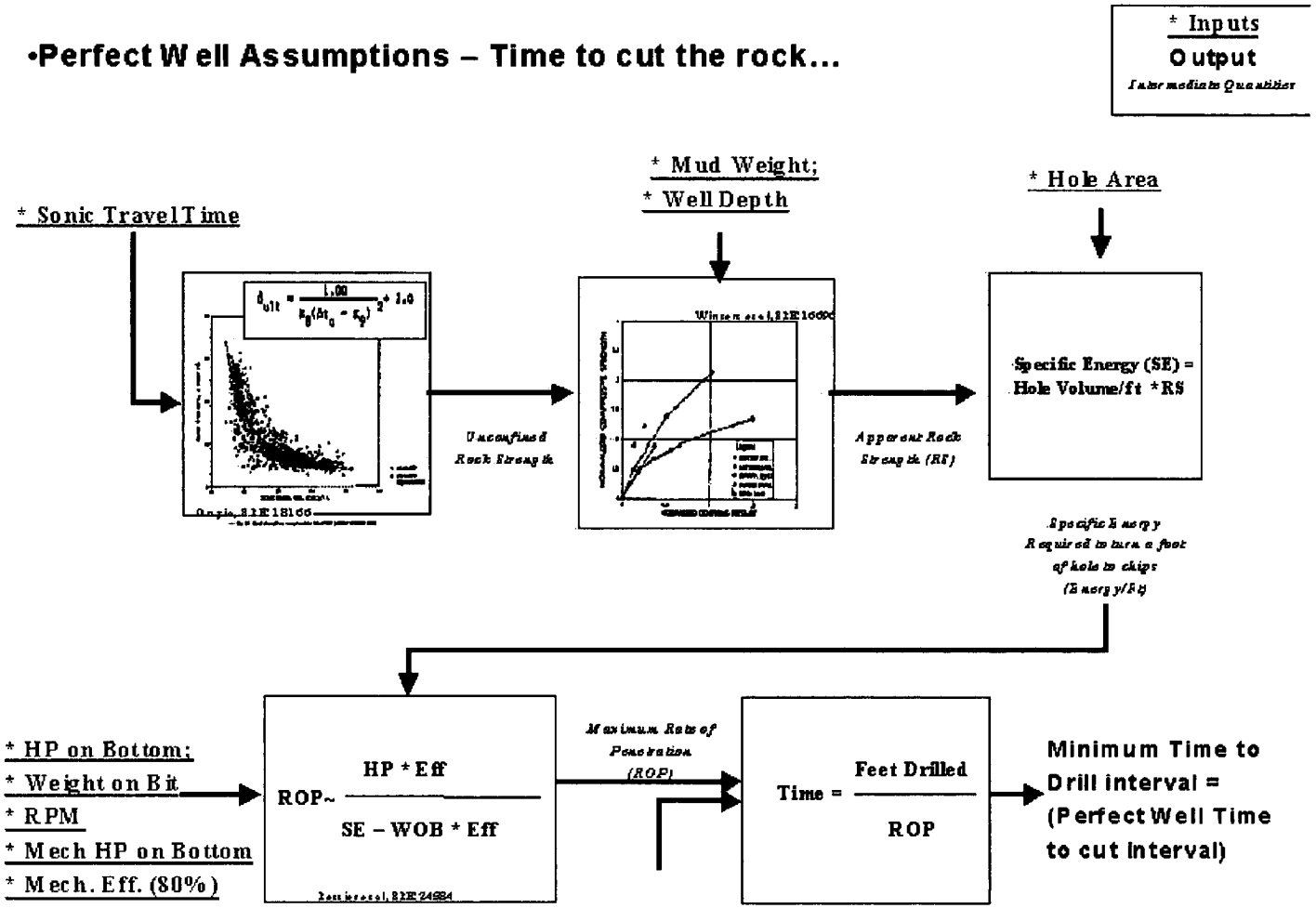
FIG. 2 is a flow chart illustrating the process to derive the time required for drilling downhole as a process step in the present invention.

The process step of drilling a certain volume of holes or "cut rock" entails the actual drilling downhole with a drill bit. As seen in FIG. 2, the time required for the drill bit to operate is correlated to the sonic travel time of a sonic seismic signal. One important innovation of the present invention uses the sonic travel time from seismic surveys as the basis for estimating the perfect well time. In this way, scoping cost estimates for drilling operations can be easily and productively estimated as a routine part of developing an exploration prospect—the perfect time is multiplied by an appropriate exploration perfect well ratio to estimate an actual time. The Specific Energy concept assumes that it takes a minimum amount of energy to cut a certain volume of hole. The time that it takes to cut a specific interval of hole depends on the horsepower being applied to the bottom hole. Assuming a sharp bit and perfectly clean bottom of the hole there is a maximum rate that rock can be cut. To estimate the minimum time to cut an interval of rock, one needs to know the horse power applied to the bottom, the compressive strength of the rock, and the area of the bottom of the hole. It is known that the compressive strength of a rock is a function of the unconfined compressive strength and the mud weight (ref. Winters). It is also known that there is also a reasonable correlation between Sonic Travel Time and unconfined Rock Strength (ref. Onyia). Both effects can be combined along with the hole size to determine the amount of minimum amount energy it will take to a volume of rock. The minimum energy assumes one perfectly sharp bit per hole section, perfect hole cleaning, and always just at pressure balance. Knowing the horsepower applied to the bottom of the hole (which will depend on hole size and rig type), one can calculate the minimum time that a particular interval of rock could possibly be drilled.

Figure 3:
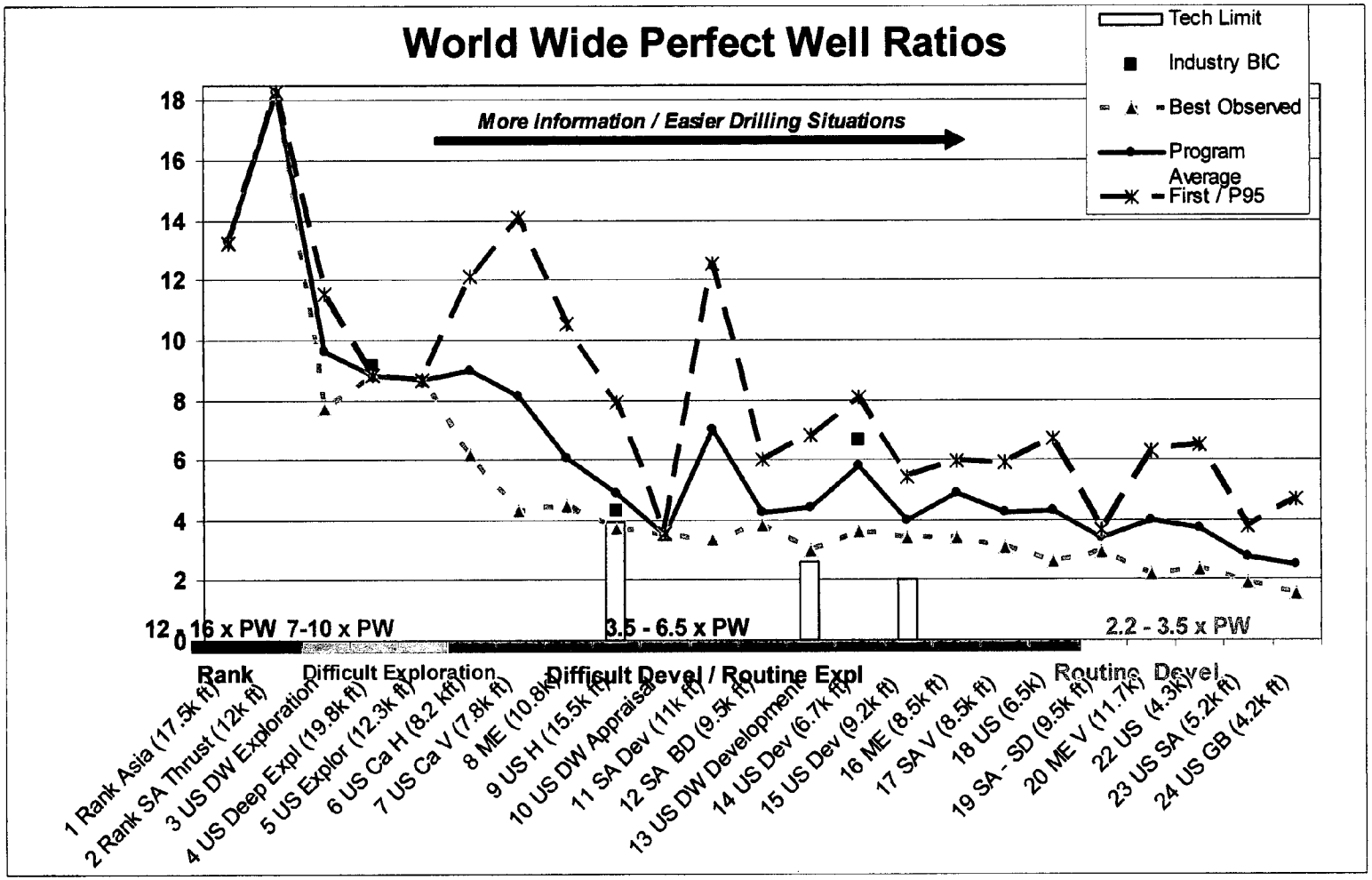
FIG. 3 is a chart of a perfect well ratio defined in accordance with the present invention against actual drilling wells or programs.

FIG. 3 summarizes over 500 wells in twenty-four different actual drilling situations worldwide. The programs varied from 4.2 k ft to 19.8 k ft in depth, from deserts to jungles, from rank wildcats to routine developments, on and offshore, on four different continents. Detailed analysis of each program confirms more difficult to produce findings from Technical Limit, Learning Curve Analysis, and Benchmark studies, and shows how the present invention can be used to as an easy key performance indicator of drilling performance.

The operations in FIG. 3 are numbered in rough order of technical difficulty from left to right ('1'being the most difficult and '24' being the technically easiest). The x-axis shows the type of operation, and the well depth. The three lines plotted on the figure show for each program the Average PWR, the Best Observed Perfect Well Ratio, and the P(97.7) well time PWR for each of the program. The P(97.7) well time represents the mean duration plus two standard deviations of a series of more than 20 substantive similar wells. (Note: programs 1, 2, 4, and 5 were single well exploration efforts and, thus, did not have a P(97.7) time calculated). Additionally, some of the programs had industry 'best in class' offsets and/or rigorously defined Technical Limits. Where available they are also shown in the figure.

FIG. 3 shows at least one powerful use of the perfect well ratio concept of the present invention. The Y axis of the chart is the perfect well ratio while the X axis illustrates 24 actual drilling situations. By classifying different types of wells/programs into different groups (e.g. Rank Exploration, Difficult Exploration, Difficult Development/Routine Exploration, and Routine Development), one can use the perfect well ratio to identify operations that are not performing as well as they might (see operations improvement table). Before the perfect well ratio of the present invention, differences in hole size, rock strength, or operational objectives, made it difficult to know how efficient a particular operation was in an absolute sense. With the perfect well concept, operations that thought performance was 'good' clearly have opportunities for improvement.

FIG. 3 shows results for Perfect Well Analysis of the 24 different operations/programs. The more rank exploration data is on the left with by progressively easier drilling operations shown to the right. The three lines represent the first or worst well in a program, the average and best observed. For single exploration wells the lines converge. Programs/wells have a regional designation (Asia, SA—South America, US-United States, ME—Middle East, along with Horizontal wells designated with an H. Other abbreviations are associated with hole diameter or a regional producing formation in order to aid 'generic' identification.

FIG. 4 illustrates a table of observations taken from FIG. 3 and depicts how the present invention can be used to identify performance of wells and also to complement other approaches.

Item 1 pertaining to well Development #9 (15.5 k ft develop in US) clearly shows the need for the perfect well methodology to complement standard industry practice. A competitor had defined 'technical limit' for the area. But that limit was not the actual limit, because clearly the best observed well in operation #9 beat the estimated technical limit.

Technical limits are estimated by a drilling team and therefore may not necessarily be an objective standard measurement. The example also shows that use of a perfect well ratio technique would have suggested that in this case the technical limit (with a PWR=4.0) was achievable. Many similar type wells have subsequently demonstrated Perfect Well Ratios of 3.5 or better. In this case, the PWR serves the organization well by creating an unambiguous performance benchmark showing much more room for improvement than a technical limit estimate indicates.

Item 2 in FIG. 4 shows the harm in just comparing to industry (14) in an area. The average for the development beat the best competitor well so it would be easy to surmise outstanding performance. The overall performance averages a PWR of 6 indicating about 50% more improvement is necessary to get to excellent performance (4 or better PWR).

Item 3 referencing well Operations #9, #10, #12, #15, #19, #23 and #24 show unambiguously excellent risk management and project performance as evidenced by a small spread in best to average well PWR and a very good average Perfect Well Ratio of less than 5 for difficult drilling and less than 4 for more routine drilling. The P(97.7) values for these programs show the spread required for analysis of risk, which is especially important for small program size (less than 5 development wells) or for appraisal drilling.

The Technical Limits defined for Developments #13 and #15 as well as actual best observed performance on routine developments #20, #21, #22, #23, and #24 show that an accurate Technical Limit for operations is in the range of 1.8 to 2 times the perfect well. For more complex wells with multiple logging runs and extensive data gathering, the Technical Limit will be a slightly higher multiple of the perfect well. Performance evaluation on these complex wells should focus more on the need and value of complexity and not necessarily on overall drilling performance time.

Figure 5:
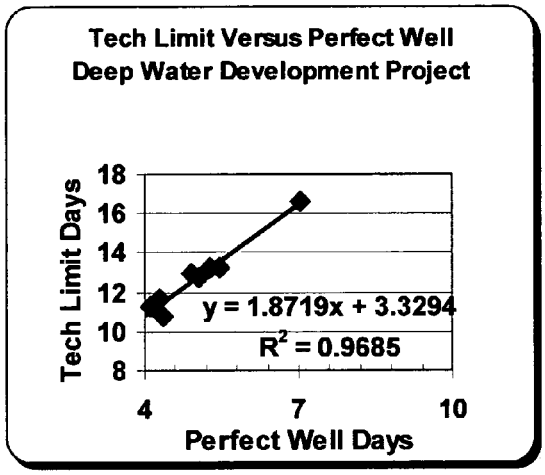
FIG. 5 illustrates a graph of regression analysis derived from one of the well groups from FIG. 3.

Item 4 illustrates the correlation of the Perfect Well ratio with disciplined Technical Limit estimates. Further, regression analysis of the well group 13 is shown in FIG. 5. This example is used because technical limit data existed on each well, an exhaustive technical limit process was used (>1 year of study), and the implied scale of the operation is one of the best resources and technology made available. FIG. 5 shows how the perfect well time—estimated in less than 2 hours—compares with that created through rigorous use of a technical limit process on nine wells drilled over the course of more than a year.

Variation in well depths and hole programs created significant differences in technical limit estimates. The Perfect well analysis correlated almost perfectly (R^2=97%) with the technical limit estimates created by the team. Also, potentially significant, is that the 'slope' of the fit is 1.87, quite close the best-observed perfect well ratio of 1.8. Essentially this means the technical limit process used by this operation very nearly creates the empirically observed best Perfect Well Ratio from the >500 wells in the study.

An estimated well duration generated by a group process whereby experts consider the best time observed on an operation and estimate the best possible time given the situation based on experienced with a particular type of well, and with a particular set of equipment.

Item 5 shows that 8 well programs achieve best well performance less than a 3 ratio (very close to technical limit) which means there is less performance enhancement possible to achieve excepting elimination of unnecessary variation such as trouble time on some wells, relearning with starts and stops.

Item 6 referencing well groups #6, #7, # 11, # 14, #15, # 16, # 18, #20 and #21 in FIG. 1 show programs most likely to be targets for enhancement. PWR Analysis indicates that target improvements in the range of 50–100% are possible because they are so far from normal PWRs for similar type wells. Achieving such gains would create cost enhancements in the range of 25–50% (assume 50% of drilling time savings results in cost savings-low end average from regression of historical day rate drilling performance). Further detailed analysis of these drilling operations did in fact show these operations could have benefitted from fewer 'starts and stops', more drilling resources, more time to plan operations, and/or better communication with and coordination by the drilling organization's customers. The point is that in these cases Perfect Well Analysis would be sufficient to identify areas where the way the drilling operations are managed could be improved.

Item 7 referencing programs 4, 5, 6 and 7 shows the performance of deep exploration wells drilled in an area offset to shallower difficult development drilling. The perfect well ratio for the two exploration wells equals the average for the shallower drilling. This supports use of the rock hardness approach and the value of using all shallow drilling data in an area to assess riskier deeper drilling performance. The wide range for the development drilling would intuitively imply wide range of risk in subsequent deeper exploration drilling.

The example below (Program #4 and #5 in FIG. 1) illustrates how the perfect well approach can gauge performance expectations of deeper drilling in regions with shallow well data. The deeper wells as shown below seem to match overall ratio though diverse in specific drilling results. The relationship seems to make sense in that the same rocks and corresponding rock hardness are drilled through in each well and the subsequent continuation through progressively deeper horizons might logically follow a similar trend.

Comparison of PWR of Exploration Wells of Dramatically Different Depths

| | Exploration Well Depth | PW Ratio | Actual Days |
|---|---|---|---|
| Program #4 in FIG. 1 | 12.3 k ft | 8.7 | 69 |
| Program #5 in FIG. 1 | 19.8 k ft | 8.8 | 261 |

Item 8 shows clearly a failure for a rank drilling project (its post audit indicated failure as well). Expected performance for similar rank wells and from competitor analysis suggested a PWR of 10 to 12 while actual results had a PWR of more than 18. Exploration drilling in a rank environment always present significant risks and are difficult to estimate. Work to date suggests that reasonable expectations of PWR should be 12 to 14, but unlike the development operations, that recommendation is based on only a few wells. A larger database and more analysis and use of worldwide experience to set targets based on realistic expectations is warranted. Compare Exploration well #3 with Appraisal well #10 and subsequent development #13. The appraisal well #10 shows a comparison of appraisal drilling to subsequent development drilling. The appraisal program appears to be very efficient as its PWR was less than 4.

Figure 6:
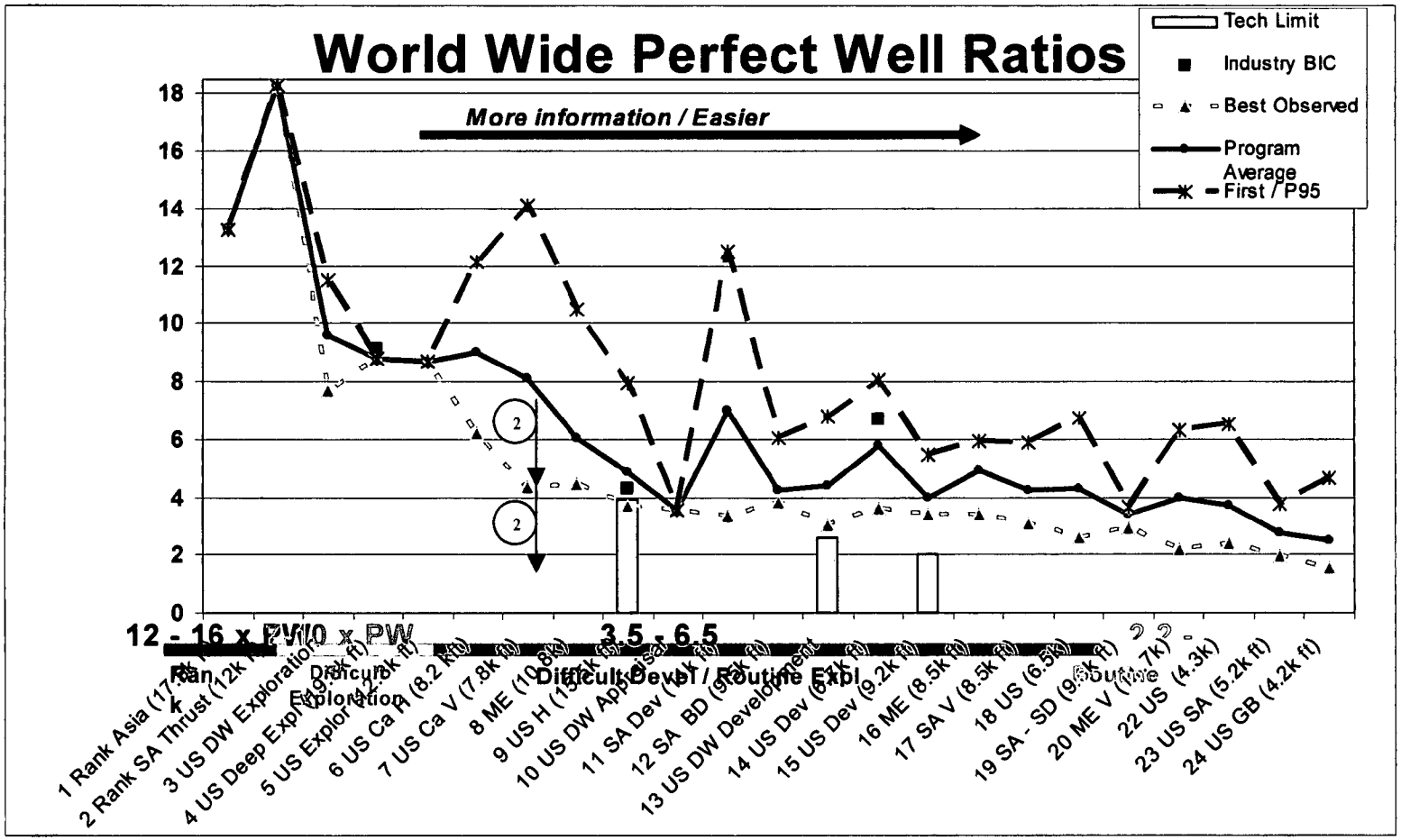
FIG. 6 illustrates the graph from FIG. 3 with further analysis on well group number 8.
Figure 7:
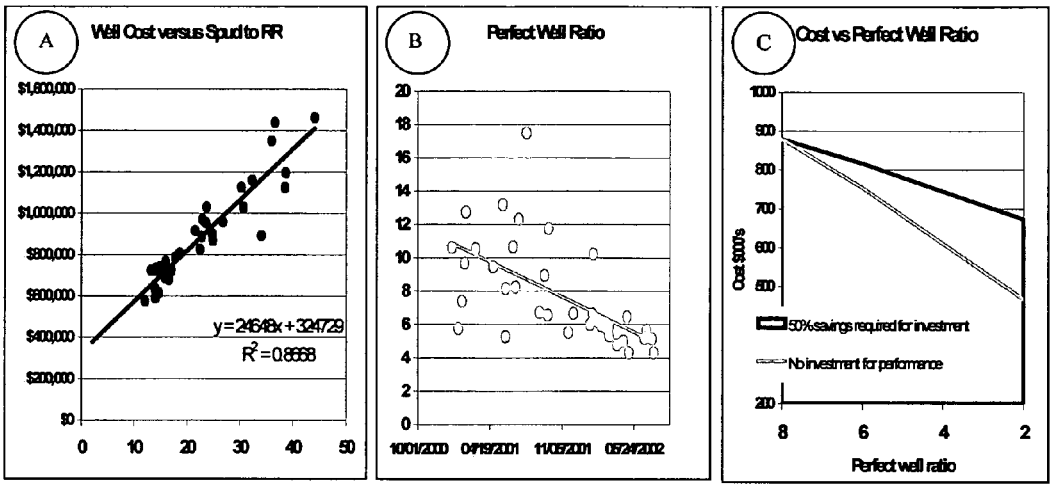
FIG. 7 is a series of three graphs and a chart relating to the data on well group number 8.

Item 9 shows a comparison of appraisal drilling to subsequent development drilling. The appraisal program appears to be very efficient since the PWR was less than 4. Further analysis was conducted on the data on well group 8 and the results shown on FIG. 6. Area 1 shows value creation opportunity associated with gaining consistency (removing trouble time and incorporating learning from best well performance attain a PWR of 4). Area 2 shows a gap that may require technology or additional investment to get to a PW ratio performance level of 2 (approximate technical limit). Estimating benefits of performance improvement is illustrated in three charts in FIG. 7 and described below.

A. Regression on current performance (cost vs. days) is completed to estimate performance improvement savings under existing commercial arrangements.

B. Perfect well ratios are examined as a function of time, note recent attainment of 4 level performance.

C. Well costs are estimated at various levels of perfect well ratio performance and levels of cost to attain performance improvement (0–50% of savings kept by contractor or service provider).

Over a 10 well program, attaining a PW ratio of 4 compared to an historical average of 8 would save $2.68 million. $1.34 million is saved compared to (recent) PW performance of 6. Depending on the cost of performance enhancing technology, a perfect cost estimate would be from $468 million to $670 million.

Commercial contracts for services complicate this analysis such that caution is advised. One should make sure that the drilling professionals and the contracting professionals are on the same page. Nevertheless, the drilling performance assessment system of the present invention supplies objective methods to evaluate and improve drilling operations.

Perfect Well Analysis can also improve application of Learning Curve Analysis. One problem with conventional Learning Curve Analysis is that it is difficult to distinguish between good learning and poor preparation. Both can show similar results. The following provides some examples of how the PWR can help clear up this ambiguity.

The example in FIG. 8 illustrates the benefit of combining the perfect well technique with learning curve analysis. Tangible goals of beginning a program at a PWR of 5 and achieving a PWR of 3 by the third to fifth well set stretch expectations that are achievable by combining the best practices of the two entities.

Figure 9:
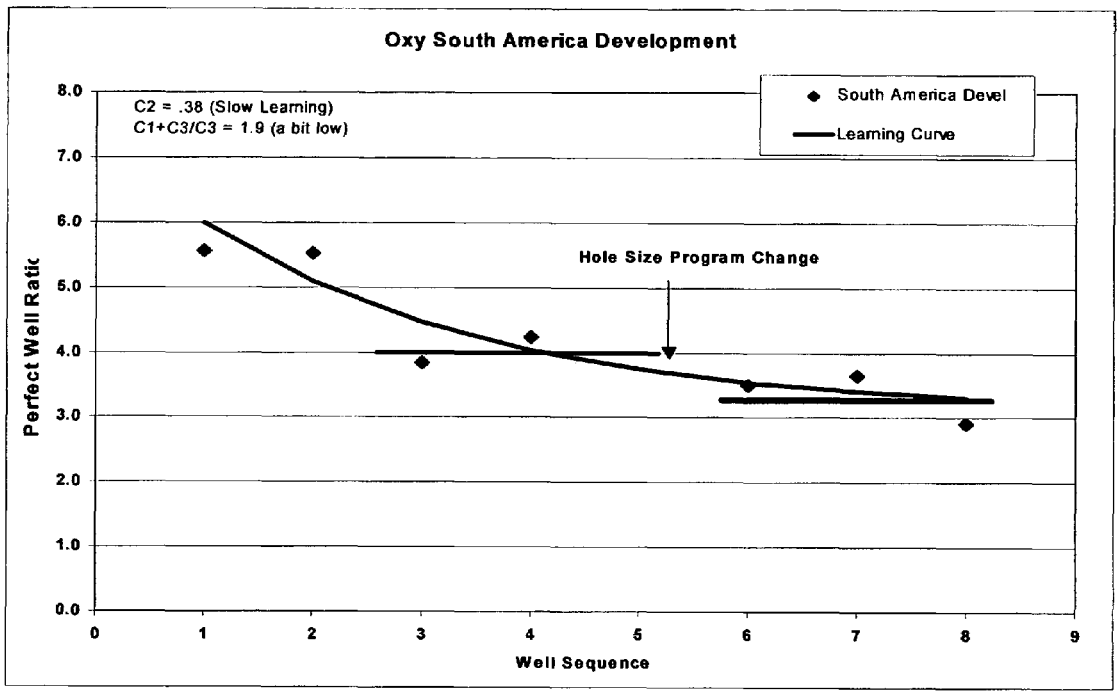
FIG. 9 is a chart illustrating the analysis of the present invention along with a hole size program change.

A second example in FIG. 9 shows that the Perfect Well technique may be used to analyze performance of a program undergoing changes in well-bore design. The specific development reached good performance by the $3^{rd}$ well and very good performance by the $6–8^{th}$ well. The PWR improvement trend is maintained through the hole size change, and shows improvement in performance from learning versus the enhancement in program design.

Often an operation is changed and the results are attributed inferentially to that operational change. This can miss the learning attribute of continuing to drill wells in the area, and becomes more important to understand when a more expensive method is used to enhance drilling performance. The additional investment should not be credited with savings associated with organizational learning. By adjusting for differences in hole program the PWR approach helps isolate the differences in performance due to program design and operational performance.

In summary, the drilling performance assessment process of the present invention provides an objective method to measure drilling performance. Once limiting parameters are assumed, one may evaluate a portfolio of drilling program in terms of performance and identify areas to apply resources that most likely will result in improvement actions yielding better results. The perfect well method provides:

An objective benchmark

A way to analyze a diverse portfolio of drilling operations

A way to validate other drilling performance methods

A way to gauge organizational and technical performance

A way to separate learning curve benefits from technical program changes to gauge change effectiveness A way to estimate cost improvement targets A way to allocate resources A way to eliminate superfluous organizational noise Whereas, the present invention has been described in relation to the drawings attached hereto, it should be understood that other and further modifications, apart from those shown or suggested herein, may be made within the spirit and scope of this invention.

What is claimed is:

1. A method to improve subterranean drilling operations by creating a drilling performance assessment ratio, which method comprises:

establishing a theoretical technical minimum time limit standard for each of multiple sequential steps required for a drilling operation;

performing an actual drilling operation having multiple sequential steps;

measuring actual time performance for said each of multiple steps for said actual drilling operation;

comparing said actual performances to said technical time limit standards to produce a drilling performance ratio; and using said drilling performance ratio to improve drilling operations by bringing said actual performances closer to said theoretical technical minimum time limit standard.

2. A method to improve subterranean drilling operations by creating a drilling performance assessment ratio as set forth in claim 1 including the additional step of examining a plurality of said ratios from actual performances over time.

3. A method to improve subterranean drilling operations by creating a drilling performance assessment ratio as set forth in claim 1 wherein said step of establishing technical minimum time limit standards includes establishing a minimum time for drilling operations to drill an interval by cutting rock using the factors of horsepower applied, compressive rock strength and area at the bottom of a hole.

4. A method to improve subterranean drilling operations by creating a drilling performance assessment ratio as set forth in claim 3 wherein said compressive rock strength is a function of sonic travel time of a signal.

5. A method to improve subterranean drilling operations by creating a drilling performance assessment ratio as set forth in claim 1 wherein said step of establishing technical minimum time limit standards includes establishing a minimum time for rigging and testing of a blow out preventer.

6. A method to improve subterranean drilling operations by creating a drilling performance assessment ratio as set forth in claim 1 wherein said step of establishing technical minimum time limit standards includes a minimum trip time for stands of pipe.

7. A method to improve subterranean drilling operations by creating a drilling performance assessment ratio as set forth in claim 1 wherein said step of establishing technical minimum time limit standards includes establishing a drill-out/leak-off test time.

8. A method to improve subterranean drilling operations by creating a drilling performance assessment ratio as set forth in claim 1 wherein said step of establishing technical minimum time limit standards includes establishing a minimum time for drilling connections.

9. A method to improve subterranean drilling operations by creating a drilling performance assessment ratio as set forth in claim 1 wherein said step of establishing technical minimum time limit standards includes establishing a minimum time for running casing in a well.

10. A method to improve subterranean drilling operations by creating a drilling performance assessment ratio as set forth in claim 1 including the additional step of classifying different drilling operations into groups.

11. A method to improve subterranean drilling operations by creating a drilling performance assessment ratio as set forth in claim 10 wherein said groups include rank exploration, difficult exploration, difficult development/routine exploration, and routine development.

12. A method to evaluate subterranean drilling performance for an actual drilling operation, which method comprises:

establishing a theoretical technical minimum time limit standard for each of multiple sequential steps required for a drilling operation;

performing an actual drilling operation having multiple sequential steps;

measuring actual time performance for said each of multiple steps for an actual drilling operation;

comparing said actual time performances to said technical time limit standards to produce a drilling performance ratio; and identifying and creating an improvement plan to improve actual drilling operations by bringing said actual time performances closer to said theoretical technical minimum time limit standard.

* * * * *